United States Patent [19]

Pike

[11] Patent Number: 4,636,391

[45] Date of Patent: Jan. 13, 1987

[54] APPARATUS AND METHOD OF FORMING A STERILE PRODUCT PACKAGE

[75] Inventor: Brian R. Pike, Carlsbad, Calif.

[73] Assignee: Patrick J. Furlong, Carlsbad, Calif.

[21] Appl. No.: 768,348

[22] Filed: Aug. 22, 1985

[51] Int. Cl.[4] ..... B65B 55/10; B65B 9/24

[52] U.S. Cl. ..... 426/106; 53/425; 53/433; 53/434; 53/511; 53/140

[58] Field of Search ..... 53/425, 426, 451, 140, 53/141, 551, 552, 403; 426/316, 319, 320, 312, 106, 236, 415; 383/3; 206/277

[56] References Cited

U.S. PATENT DOCUMENTS

| | | | |
|---|---|---|---|
| 1,789,946 | 1/1931 | Rector | 426/316 X |
| 2,275,154 | 3/1942 | Merrill et al. | 53/140 X |
| 2,751,305 | 6/1956 | Kaloyereas | 426/320 |
| 2,928,219 | 3/1960 | Gubler | 53/141 X |
| 2,955,940 | 10/1960 | Williams | 53/403 X |
| 2,962,843 | 12/1960 | Hoelzer et al. | 53/451 X |
| 3,084,052 | 4/1963 | McLaughlin | 426/316 |
| 3,163,971 | 1/1965 | Loliger et al. | 53/426 |
| 3,164,936 | 1/1965 | Loliger | 53/141 X |
| 3,311,949 | 4/1967 | Moran | 53/140 X |
| 3,399,508 | 9/1968 | Frielingsdorf et al. | 53/140 |
| 3,456,861 | 7/1969 | Wettlen | 53/451 X |
| 3,466,850 | 9/1969 | Hudson et al. | 53/426 |
| 4,099,914 | 7/1978 | Gustafsson et al. | 53/426 |

OTHER PUBLICATIONS

Webster's Seventh New Collegiate Dictionary, G & C Merriam Company-2nd Definition of "inert".

*Primary Examiner*—Horace M. Culver

*Attorney, Agent, or Firm*—Charles E. Brown; Charles A. Brown

[57] ABSTRACT

This relates to the sterile packaging of sterile products. A suitable thermoplastic film tube is formed by an extrusion process wherein the resultant tube is initially sterile internally and externally. The shape of the tube is maintained by a gas supplied under pressure, which gas is maintained in a sterile condition. The resultant tube portions, containers or pouches are filled utilizing filling equipment which is disposed within a housing of the sterile gas supply apparatus and is maintained externally in a sterile state by a suitable heater or other external sterilization methods. A sterile product is delivered from a sterile kettle or the like through a conduit to the filling equipment. The conduit and the filling equipment may be internally sterilized by circulating a suitable chemical sterilizing liquid therethrough as an initial part of the product packaging operation.

15 Claims, 1 Drawing Figure

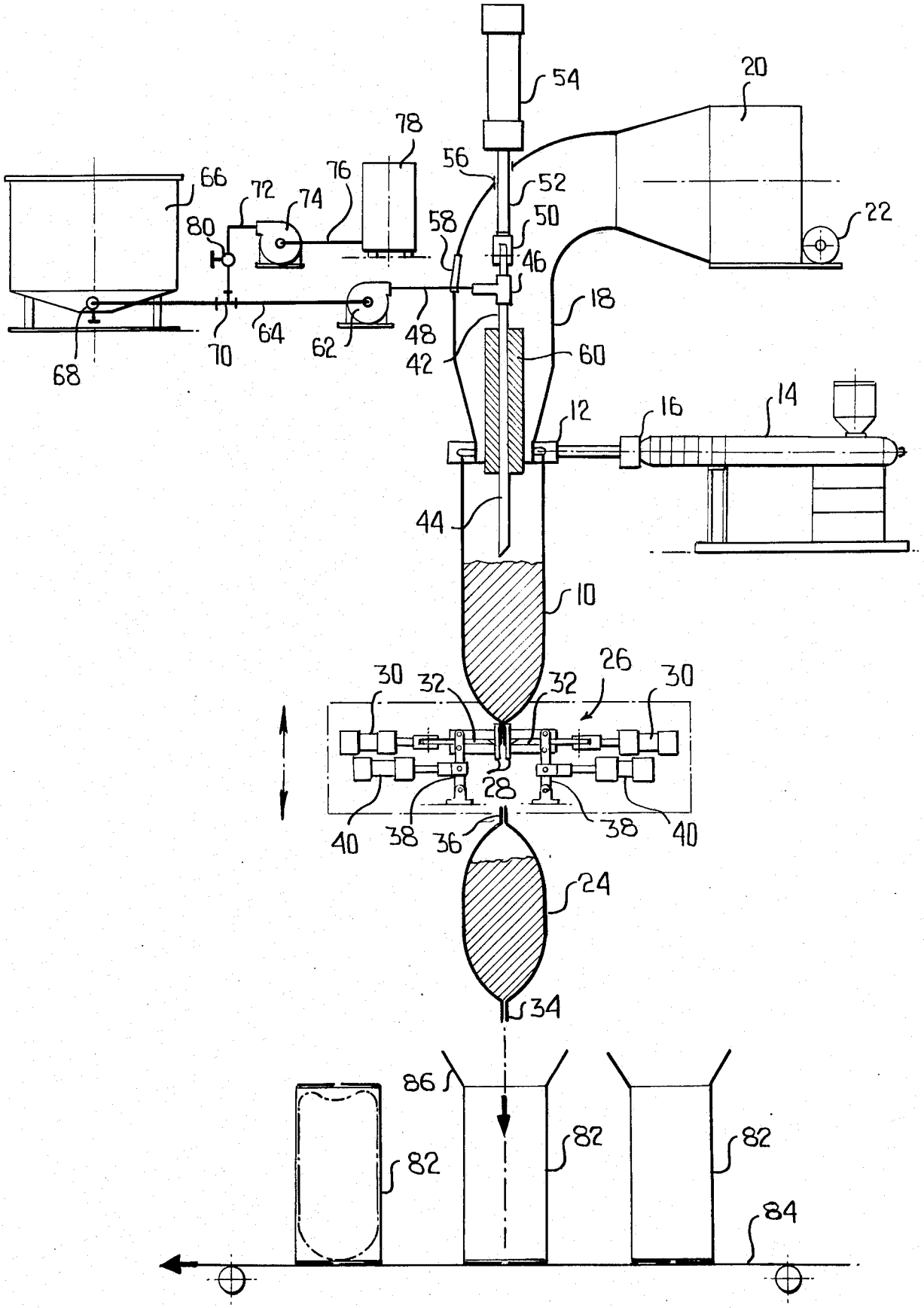
54
20
78
56
52
66
72
74
76
50
22
80
58
46
18
64
48
70
62
42
60
68
12
16
14
44
10
26
30
32
32
30
28
40
38
36
38
40
24
34
86
82
82
82
84

APPARATUS AND METHOD OF FORMING A STERILE PRODUCT PACKAGE

This invention relates to the sterilization of food and food packages on a continuous basis.

A primary object of this invention is to provide a package containing sterile contents that does not require terminal sterilization. The many significant problems entailed in accomplishing this objective include:

1. Manufacture of a sterile package.
2. Maintenance of the sterility of that package prior to filling.
3. Sterilization of the product contained within the package.
4. Sterilization of the filling apparatus used to place the sterile product within the sterile package.
5. Sterilization of the atmosphere surrounding the sterile product filling apparatus, the sterile product, and the sterile package.

In accordance with this invention, there is provided a "bubble" type plastic film extruder which extrudes the plastic film into tubular film at a temperature above sterilization temperature.

The plastic film tube is maintained in an open state by a sterile gas directly blow thereinto under sufficient pressure at least to maintain the shape of the extruded tube.

The product to be packaged under sterile conditions is provided in a sterile state.

Suitable sterilizing equipment is provided to effect the necessary sterilization of filling components including conduits.

The drawing is a schematic view with parts broken away and down in section of a production system incorporating the invention.

Referring now to the drawing, it will be seen that the package forming device is in the form of a continuously extruded plastic film tube 10 which is preferably formed of polyethylene or polypropylene although the tube 10 could be co-extruded to include a barrier layer if so desired.

The plastic film tube 10 is formed by way of an extrusion ring 12 which receives melted plastic material under pressure from a plasticizer 14 which is provided with a suitable extrusion head 16.

The plastic material film which defines the tube 10 is extruded at a temperature which is sufficiently high to ensure the sterility of both the inner and the outer surface of the plastic film tube 10. The extrusion temperature will be on the order of 600° F. and greater.

At this time it is pointed out that the plastic film is initially formed as a bubble and as the bubble is formed and extrusion of the plastic material continues, the extruded tube is shaped by way of a suitable gas (air) being introduced through the extrusion ring 12 so as to at least maintain the shape of the extruded tube 10.

Sterile gas is introduced through the extrusion ring 12 by means of a shaped housing 18 to which there is coupled a suitable sterilization unit 20 which includes a blower 22. When air is utilized as the sterile gas, atmospheric air is drawn into the sterilization unit 20 by way of the blower 22 and is forced through the housing 18 and through the extrusion die 12 into the initially formed bubble to expand the same and form the tube 10. With the exception of the fact that the tube forming gas is sterile, the tube forming equipment is conventional.

In order that the newly formed tube 10, after a suitable product is placed therein, may be separated into individual containers identified by the numeral 24, there is provided the combination sealer and separator generally identified by the numeral 26. The tube 10 is clamped closed at regular intervals and heat sealed together by means of a pair of heat sealing jaws 28. The heat sealing jaws 28 are mounted for reciprocatory movement by way of extensible fluid motors 30 which operate in unison to either move the heat sealing jaws 28 apart sufficiently for the tube to pass therethrough or to bring the heat sealing jaws 28 together so as to clamp therebetween a section of the tube 10 and heat seal the tube material to close the newly formed tube 10 at one end thereof.

There is associated with the heat sealing jaws cooperating cutters 32 which, when actuated, cooperate to cut the tube intermediate the top or bottom of the heat seal formed therein. The cutters or knives 32, as a result, divide the newly formed heat seal in half so as to define a lower heat seal 34 of one container 24 and an upper heat seal 36 of the preceding container.

The cutters or knives 32 are carried by pivotally mounted supports 38 which are positioned by means of extensible fluid motors 40.

It is to be understood that the sterile tube 10 is to be filled with a sterile product under sterile conditions. To this end there is provided filling equipment generally identified by the numeral 42. The filling equipment 42 basically is in the form of an elongated nozzle 44 connected by a T-fitting 46 to a supply conduit 48. The third leg of the T-fitting 46 is closed and has attached thereto a yoke 50 carried by a piston rod 52 of an extensible fluid motor 54. It is to be noted that the filling equipment is disposed within the housing 18 and the piston rod 52 extends through a sealed opening 56 in the wall of the housing 18. It is also to be understood that the supply conduit 48 is mounted within a sealed opening 58 of a wall of the housing 18.

It is to be understood that inasmuch as the filling equipment is disposed within the housing 18 and the sterilized air flows about the filling equipment, it is necessary the filling equipment be sterilized both externally and internally. In a preferred emodiment of the invention, there is fixedly mounted within the housing 18 an elongated heater 60. As shown, the lower end of the heater 60 extends through the extrusion ring 12 a very limited amount. In practice, the nozzle 44 extends below the heater 60 but may be retracted so as to be generally within the confines of the heater 60 during the formation of the bubble. In this manner the filling equipment may be externally sterilized.

At this time, it is pointed out that the external sterilization means for the filling equipment may also be in the form of separate heaters embedded in the nozzle or filling spout 44. On the other hand, it is also feasible to provide a chemical sterilization liquid spray (not shown) for effecting the external sterilization of the filling equipment.

The supply conduit 48 has coupled thereto a suitable pump 62 which, in turn, has coupled thereto a supply conduit 64. The supply conduit has its opposite end coupled to a vat 66 by way of a valve 68. The vat 66, which in the case of a sterile food, is a cooking kettle, effects the sterilization of the product to be placed within the containers 24.

In order that the conduit 64, the pump 62 and the supply conduit 48, as well as the filling equipment may be made internally sterile, it is proposed to provide for liquid sterilization. To this end, the conduit 64 has incorporated therein a T-fitting 70 by means of which a conduit 72 from a pump 74 is coupled to the conduit 64. The pump 74 has coupled thereto a supply conduit 76 leading from a supply source 78 for a sterilization liquid. The conduit 72 has incorporated therein a valve 80 which is normally closed after the initial sterilization has been effected. It is to be understood that the initial sterilization will be effected while the valve 68 is closed.

OPERATION

With the nozzle or filling spout 44 retracted, a plastic bubble is initially formed in the normal manner. Then as the plastic film is extruded in tubular form from the extrusion ring 12, gas under pressure is introduced into the newly formed bubble with the result that the bubble is extended and becomes of a tubular shape defining the tube 10. Before the initial bubble formation is effected, the heater 60 has been turned on so as to externally sterilize the filling equipment.

After the forming of the tube 10 has been initiated, the valve 80 is opened while the valve 68 is closed and the pumps 74, 62 are actuated. This results in the pumping of a sterilization liquid through the conduit 64 and through the filling equipment with this liquid passing through the spout 44 into an upper portion of the newly formed tube. As this liquid sterilization is being effected, the end result is the forming of a series of containers 24 in the normal manner but wherein the containers are filled with a sterilizing liquid from the sterilizing liquid supply 78.

When sufficient internal sterilization has been effected, the valve 80 will be closed and the valve 68 opened. The pump 62 will at this time be supplied with a sterile product to be placed within the tube 10. After a limited run sufficient to remove the sterilizing liquid from the conduit 64 and the filling equipment, a product packaging operation will be effected with the previously filled containers 24 being discarded. The system is now ready for continuous operation wherein the sterile plastic film tube 10 has the shape thereof maintained by a sterile gas under pressure and the product being placed within the tube is maintained in a sterile state prior to the filling operation.

It is to be understood that the containers 24 are preferably packaged within other containers. For example, the filled containers 24 may be placed within paperboard boxes 82 which are passed in timed sequence below the packaging equipment on a conveyor 84. As each box 82 becomes aligned with the tube 10 being filled, a newly formed container 24 is separated from the remainder of the tube 10 and the resultant package drops into that box. After the box 82 has been filled with a filled container 24, top closing flaps 86 are moved to carton closing positions and bonded together to form a complete package.

At this time it is pointed out here that in lieu of the filled containers 24 being placed in the boxes or cartons 82, as an alternative, the containers or pouches 24 may be wrapped in another separate web of packaging material as on a vertical form and fill machine to produce flexible pouches with sterile contents or the sterile product containing pouches could be placed into preformed flexible bags to accomplish the same objective.

Although only a preferred embodiment of the invention has been specifically illustrated and described herein, it is to be understood that minor variations may be made in the apparatus and the method of utilizing the same without departing from the spirit and scope of the invention as defined by the appended claims.

I claim:

1. Apparatus for forming sterile packages containing a sterile product, said apparatus comprising an extruder ring for extruding a bubble like tube of thermoplastic film at a self-sterilizing temperature, a sterile gas supply coupled to said extruder ring for introducing gas into a newly extruded sterile thermoplastic film tube portion at at least a shape maintaining pressure; filling equipment mounted within said sterile gas supply in a position to dispense a sterile product through said extruder into said sterile thermoplastic film tube portion, means within said sterile gas supply for at least externally sterilizing said filling equipment; a source of a sterile product; conduit means connecting said source of a sterile product with said filling equipment, and sterilizing means coupled to said conduit means for at least internally sterilizing said conduit means whereby a sterile product is delivered to said filling equipment, and means for separating said sterile thermoplastic film tube into closed containers which are internally sterile and have therein a fill of a sterile product.

2. Apparatus according to claim 1 together with means for supplying individual protective containers for receiving said closed hot containers immediately after forming of said containers.

3. Apparatus according to claim 1 wherein said means for at least externally sterilizing said filling equipment is in the form of a heater surrounding a portion of said filling equipment.

4. Apparatus according to claim 1 wherein said filling equipment includes an elongated nozzle, and said means for at least externally sterilizing said filling equipment is in the form of a heater surrounding said nozzle.

5. Apparatus according to claim 4 wherein said nozzle is of a greater axial length than said heater and extends through said extruder ring.

6. Apparatus according to claim 4 wherein said nozzle is of a greater axial length than said heater and extends through said extruder ring, and said filling equipment being carried by an extensible support for advancing and retracting said nozzle through said heater.

7. Apparatus according to claim 4 wherein said nozzle is of a greater axial length than said heater and extends through said extruder ring, said heater also extending through said extruder ring.

8. Apparatus according to claim 1 wherein said sterilizing means coupled to said conduit means includes a source of a sterilizing medium separate and apart from said sterile gas, and means for effecting control of flow of said sterilizing medium through said conduit means and said filling equipment.

9. A method of providing and filling portions of a sterilized plastic film tube with a sterile product, said method comprising the steps of extruding a plastic film tube at a temperature sufficient to ensure sterility of both inner and outer surfaces of the plastic film tube, supplying a sterile gas to the plastic film tube as it is being formed at a pressure at least as great to maintain the shape of the plastic film tube, supplying a sterile product through the sterile gas into the plastic film tube as the plastic film tube is being formed, and sealing off and separating filled plastic film tube portions.

10. A method according to claim 9 wherein the sterile product is supplied from a remote source to filling equipment located within the apparatus for the supplying of sterile gas.

11. A method according to claim 10 wherein prior to an initial filling of a plastic film tube portion with a sterile product the filling equipment is externally sterilized utilizing sterilizing means mounted within the apparatus for the supplying of sterile gas.

12. A method according to claim 11 wherein prior to an initial filling of a plastic film tube portion with a sterile product all conduits for supplying a sterile product from the remote source to the filling equipment and the filling equipment are internally sterilized by flow of a sterile medium separate and apart from said sterile gas through the conduits and the filling equipment.

13. A method according to claim 10 wherein prior to an initial filling of a plastic film tube portion with a sterile product all conduits for supplying a sterile product from the remote source to the filling equipment and the filling equipment are internally sterilized by flow of a sterile medium separate and apart from said sterile gas through the conduits and the filling equipment.

14. A method according to claim 10 wherein the filling equipment normally extends through an extruder ring forming the plastic film tube, and the filling equipment is retracted relative to the extruder ring to permit the forming of a bubble as an initial step in forming of the plastic film tube.

15. A package comprising a closed internally sterile plastic film tube having therein a sterile product, said package being formed in accordance with the method of claim 9.

* * * * *